US006630026B1

(12) United States Patent
Kiiha et al.

(10) Patent No.: US 6,630,026 B1
(45) Date of Patent: Oct. 7, 2003

(54) APPARATUS FOR SPREADING TREATING MIX ON A MOVING PAPER—OR CARDBOARD WEB

(75) Inventors: Timo Kiiha, Menasha, WI (US); Petri Parni, Chonburi (TW); Petri Joutjärvi, Kouvola (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/936,546

(22) PCT Filed: Mar. 14, 2000

(86) PCT No.: PCT/FI00/00202

§ 371 (c)(1),
(2), (4) Date: Nov. 19, 2001

(87) PCT Pub. No.: WO00/55425

PCT Pub. Date: Sep. 21, 2000

(30) Foreign Application Priority Data

Mar. 15, 1999 (FI) ..... 990573

(51) Int. Cl.[7] ..... B05C 3/02
(52) U.S. Cl. ..... 118/413; 118/414
(58) Field of Search ..... 118/410, 419, 118/411, 413, 414; 427/356

(56) References Cited

U.S. PATENT DOCUMENTS

| | | | | |
|---|---|---|---|---|
| 4,903,632 A | | 2/1990 | Sollinger | 118/123 |
| 5,192,591 A | * | 3/1993 | Chance | |
| 5,683,510 A | | 11/1997 | Li et al. | 118/410 |
| 5,720,816 A | | 2/1998 | Li et al. | 118/410 |
| 5,824,369 A | | 10/1998 | Li et al. | 427/345 |

FOREIGN PATENT DOCUMENTS

| | | | |
|---|---|---|---|
| JP | 0773 321 A2 | 5/1997 | D12H/23/36 |
| WO | WO 93/10309 | 5/1993 | D21H/23/36 |
| WO | WO 97/13034 | 4/1997 | D21H/23/36 |

* cited by examiner

*Primary Examiner*—Brenda A. Lamb
(74) *Attorney, Agent, or Firm*—Cohen, Pontani, Lieberman & Pavane

(57) ABSTRACT

An apparatus for applying a treating mix onto the surface of a moving device in the coating of paper or board. The apparatus comprises a blade carrier (3), doctor means (4) attached to the blade carrier (3), a front wall (9) positioned a distance from the doctor means (4), a device (1) constituting the moving device, said device being arranged in conjunction with the front wall (9) and the doctor means such that it forms a chamber (6, 7) with the front wall (9) and the doctor means, and means (8) for supplying treating agent into an area of the application chamber (6, 7) which is at least essentially opposite to the moving surface. To prevent streaks, a screen plate (10) is fitted in the application chamber, at least partly dividing the application chamber (6, 7) such that with regard to the screen plate (10), the doctor means (4) is arranged on the opposite side thereof to the feed means for the treating agent.

23 Claims, 4 Drawing Sheets

APPARATUS FOR SPREADING TREATING MIX ON A MOVING PAPER— OR CARDBOARD WEB

PRIORITY CLAIM

This is a national stage of PCT application No. PCT/FI00/00202, filed on Mar. 14, 2000. Priority is claimed on that application, and on patent application No. 990573 filed in Finland on Mar. 15, 1999.

FIELD OF THE INVENTION

The present invention concerns an arrangement for applying a coating mix, a surface sizing agent, or some other treating agent onto the surface of a moving base material web in the manufacture of coated paper or board.

BACKGROUND OF THE INVENTION

Different kinds of treating agents can be applied onto the surface of a base material web in order to improve the printability properties of paper or board. The most common agents used include solid mineral agents, starch-based sizing agents, latex agents and various kinds of mixes. Printability is mainly improved by different mixes of solid substances applied onto the web surface in the form of coating slips mixed with water. Other agents can be used to act on e.g. the strength and water resistance of the base web. In addition, different kinds of special grades of paper are manufactured whose surface is coated with, e.g. micro capsules in order to produce a self-copying surface.

Different coating or application methods are used for the different treating agents. Short-dwell application constitutes a versatile coat application method wherein the coating mix is applied onto the web from a chamber restricted in the travel direction of the web by a front wall and a doctor blade or rod. The coating mix is transferred onto the web from the chamber and is smoothed immediately after application by means of the doctor device limiting off the chamber. The coating mix is fed into the application chamber through a feed slit in the bottom of the chamber. The supply of coating mix should be as even as possible in order to obtain maximal steadiness of the pressure of the coating mix on the web limiting off the chamber. Part of the coating mix is led over the front wall of the chamber into the incoming direction of the web. Outflow is used in seeking to achieve an even web damping line and to prevent the air brought along by the moving web from entering the application chamber.

Short-dwell application has a number of considerable benefits which make it well suited for the manufacture of certain grades of paper. In short-dwell application little damping of the base web occurs because the pressure on the application area is short and the pressure in the chamber is small. Thus, the application process imposes little strain on the web and, owing to the low degree of damping, better web strength is retained after application. As the smoothing out of the coat almost coincides with the application step, the coating mix does not have time to set onto the web surface and the effort needed for doctoring is smaller; hence, even this contributes to the smaller strain imposed on the web. Short-dwell application arrangements achieve small amounts of coating mix more easily than many other types of application devices, wherefore they are well suited for the manufacture of light weight coated (LWC) paper grades, and, due to the small strain the web is exposed to, for grades having a low grammage or strength value.

A moving web which limits off the application chamber gives rise to turbulence in the application chamber, and the flow rate of the coating mix at the surface of the web is equal to web velocity but is reduced towards the inside of the chamber. The turbulence is further affected by the feed flow of the coating mix. This turbulence is one of the reasons, according to present understanding the most important one, for the problem with short-dwell application, i.e. striation of the coat, or the occurrence of occasional streaks. Streaks in the web occur particularly at high velocities and in the case of large amounts of coating mix, and are thought to be a consequence of the unstability of the damping line of the web and the unstable flows in the application chamber. The term damping line is used to refer to the cross-machine line at which the web meets the coating mix. Usually this line runs essentially at the front wall of the application chamber, slightly into the incoming direction of the web. An unstable, serrated damping line and unstable flows in the cross direction of the web give rise to local differences in the thickness of the mix at the doctor blade, and thus in the impulse force exerted on the doctor blade.

Streaks in coated paper restrict the use of current short-dwell coating apparatuses at high velocities, because turbulence and streakiness are naturally the greater, the higher the velocity of the web when it passes the application chamber.

Two separate turbulences are generated in the chamber, the one in the immediate vicinity of the doctor blade close to the tip thereof being smaller than the turbulence formed in the middle of the chamber by the flow returning from the doctor blade and turning again into the web direction. The intensity of the greater turbulence is further enhanced by the movement of the coating mix supply flow from the lower edge of the chamber. The role played by these two turbulences in the appearance of streaks is not explicitly known but possibly one of the turbulences gives rise to changes in pressure in the chamber. Changes in pressure alter the force balance at the tip of the blade whereby the doctor force and the amount of coating mix remaining on the web undergo a local and short-duration change.

The occurrence of streaks may take a positive or a negative form, i.e. the amount of coating mix may increase or decrease locally with regard to the desired amount of coating mix. The occurrence of streaks resulting from turbulences in the application chamber is rapidly increased when the velocity of the web to be coated exceeds 1000 m/min.

SUMMARY OF THE INVENTION

The present invention aims at providing a short-dwell applicator which can be used to at least reduce the occurrence of streaks and which can be run at speeds exceeding those in use today.

The invention is based on a screen plate being adapted in the application chamber, dividing the application chamber such that the feed orifice or orifices for the treating agent are on one side of the screen plate and the doctor is on the other side of said plate.

According to an advantageous embodiment of the invention, an adjustable spout is adapted at the front edge of the application chamber, said spout being movable in the travel direction of the web in relation to the doctor such that the surface area of the part of the application chamber which is in contact with the web can be adjusted, i.e. the length of the application chamber can be altered in the travel direction of the web. At the same time it is possible to affect the dwell time of the application as well as the length of the pressure impulse.

The invention achieves considerable benefits.

The screen plate can be used to considerably reduce or even eliminate the occurrence of streaks, which makes it possible to increase web speed without giving rise to any streaks. The screen plate prevents turbulence caused by the return flow from the doctor blade or rod toward the lower part of the application chamber by decelerating the flow and by levelling down any local variations in speed and pressure. With the making even of the pressure in the application chamber and the velocity distribution of the flows, the force exerted on the doctor means is also even, thus resulting in a coating layer of homogeneous thickness. The invention renders it easier to achieve greater amounts of coating mix, which gives the short-dwell applicator a broader range of possible uses. The coating mix is usually applied in an amount of 5 to 13 g/m$^2$.

The front edge of the chamber can be used to optimize the operating conditions during runs in accordance with velocity, paper grade, and treating agent, and during the sealing of the web the chamber orifice can be set such that it is very small, thus preventing any wetting of the seal. If the spout is adapted such that it is adjustable even in the lateral direction of the web by fitting it with profiling equipment, the wetting line between the web and the mix can be altered, thus affecting the coating mix profile to remain on the web. The screen can also be used to close the side of the application chamber on the side of the supply orifice altogether such that any paper chaff possible coming off the web is prevented from blocking the supply orifice. The formation of paper chaff is at its maximum during breaks but some fibres always come off the web when it is treated.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENT

Figure 1:
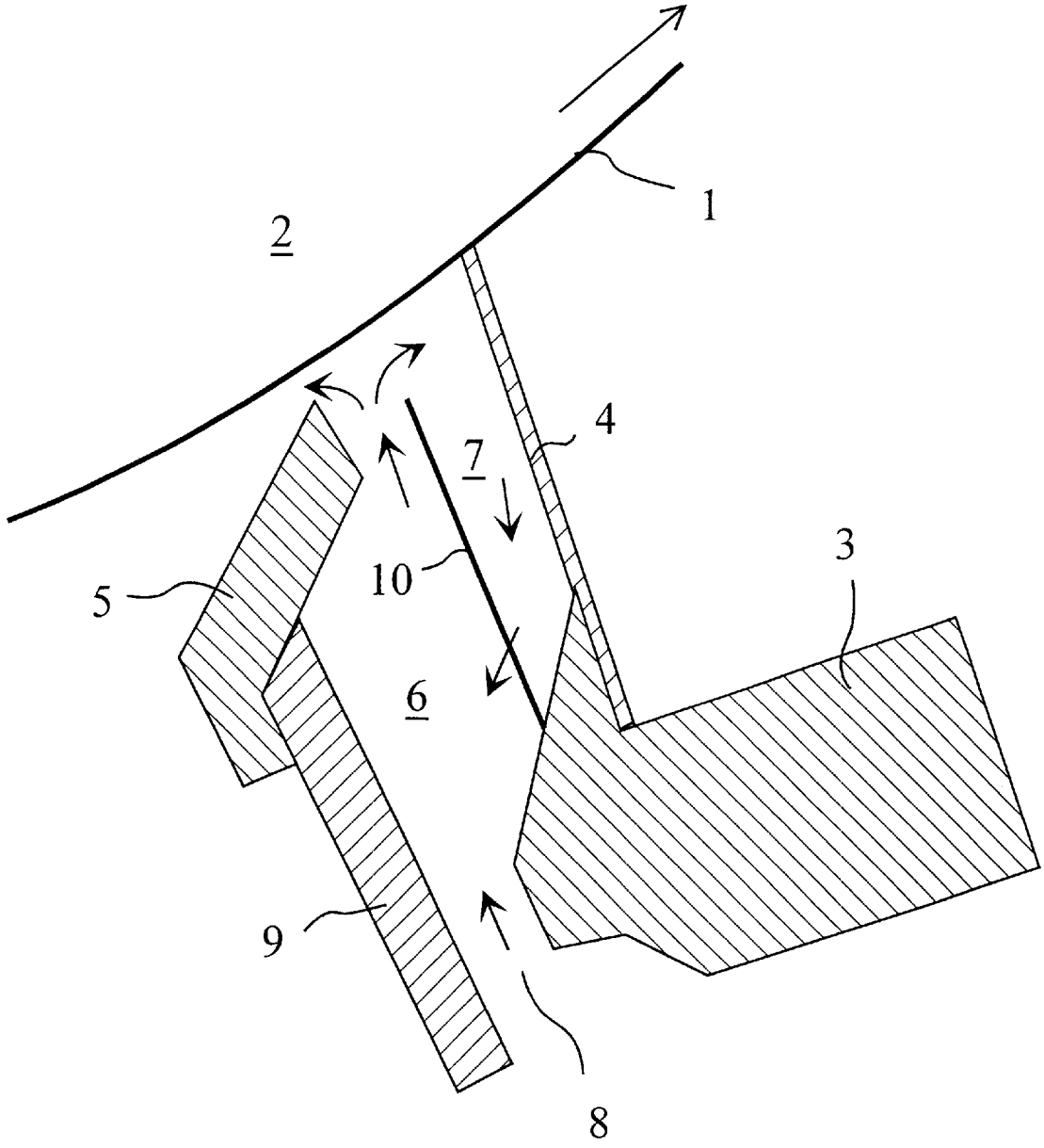
FIG. 1 is a schematic cross-section of a short-dwell applicator according to the invention.

As described above, short-dwell applicators comprise a doctor blade 4 attached to a blade holder 3, a front wall 9 and an application chamber 6, 7 limited off by the web 1 being treated. The web 1 usually travels supported by a backing roll 2 at the application chamber. The front wall 9 of the application chamber 6, 7 is arranged at a distance from the doctor blade 4 such that an orifice remains between the front wall 9 and the doctor blade 4, through which the treating agent supplied into the application chamber 6, 7 is fed onto the web 1. The feed orifice or orifices for the agent are at the lower part of the application chamber 6, 7. An excess of the treating agent is fed into the application chamber 6, 7, and part of it flows over the upper part of the front wall 9 and the spout 5 forming the edge of the application area into the incoming direction of the web. The purpose of such overflow is to prevent air from entering the chamber and to achieve an even wetting line. In the lateral direction of the web, then, the application area is limited off by edge seals.

The agent used to treat the web, e.g. a coating mix, flows in the application chamber as indicated by the arrows. The mix is fed into the chamber 6, 7 usually through several feed orifices fitted over the width of the web and the coater or through a wide cross machine orifice 8 into the lower part of the chamber. From there the mix flows towards the web 1 and the application area formed by the spout 5 in the front wall and the doctor blade 4. Inside the chamber, the moving web 1 creates a flow towards the doctor blade 4, and a specified dosage of coating mix flows onto the web 1 below said blade. The excess mix flows partially over the spout 5 into the incoming direction of the web 1 and partially towards the root and attachment point of the blade 4. Close to the root of the blade 4 this flow meets the flow from the feed orifices 8 and turns back towards the web 1. A screen plate 10 is mounted at a distance from the root of the blade 4, dividing the application chamber into a feed side 6 and a return side on the side of the blade 10. The screen plate 10 extends through the application chamber 6, 7 in the lateral direction of the chamber and is provided with holes through which the return flow can flow into the lower part of the chamber. When the material for treating the web flows through the holes in the screen plate, its velocity and pressure distributions become even,- and the occurrence of turbulence is reduced. The screen plate is very thin, preferably 0.2 to 3 mm, and it may be perforated throughout, or it may comprise holes only at the lower part or upper part of the plate 10. The shape of the holes can be chosen quite freely and they may have e.g. a circular or a slit-like shape. The distance from the tip of the screen plate 10 to the web 1 may vary and is preferably from 0.5 to 15 mm, and is set at an angle of 0 to 135° with regard to the tangent of the radius of curvature of the web. This refers to the angle between the tangent of the radius of curvature of the web and a straight line parallel with the screen on the lag side of the web. What is essential, however, is that the application chamber is divided into two parts by the screen plate 10, the supply orifice for the agent used to treat the web opening into one part and the other part being fitted with the doctor blade or rod or some other doctor means. Thus, the return flow from the doctor means 4 does not intensify feed flow directly but is instead dampened through being screened through the plate.

Figure 2:
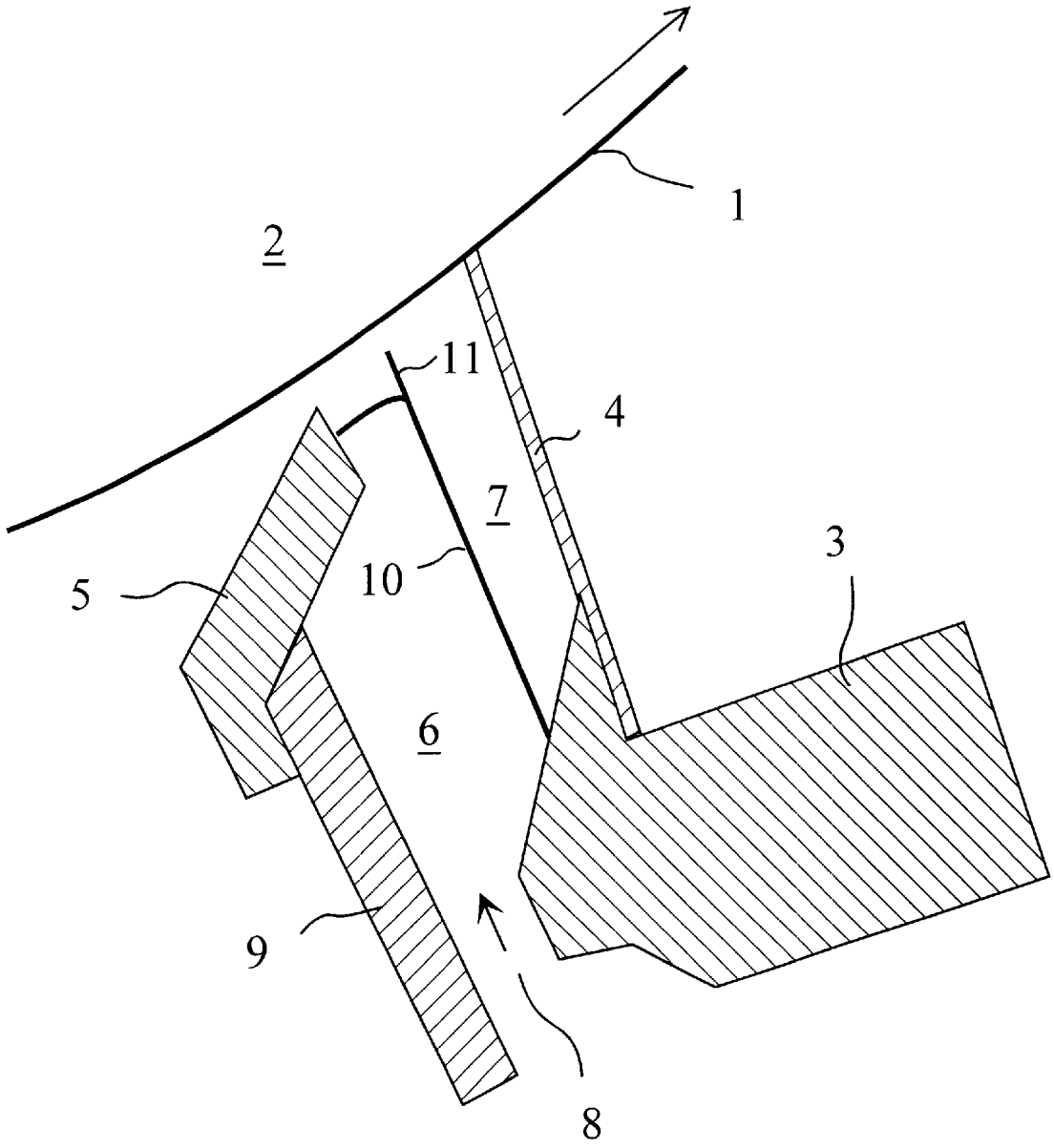
FIG. 2 is a schematic cross-section of another short-dwell applicator according to the invention.
Figure 3:
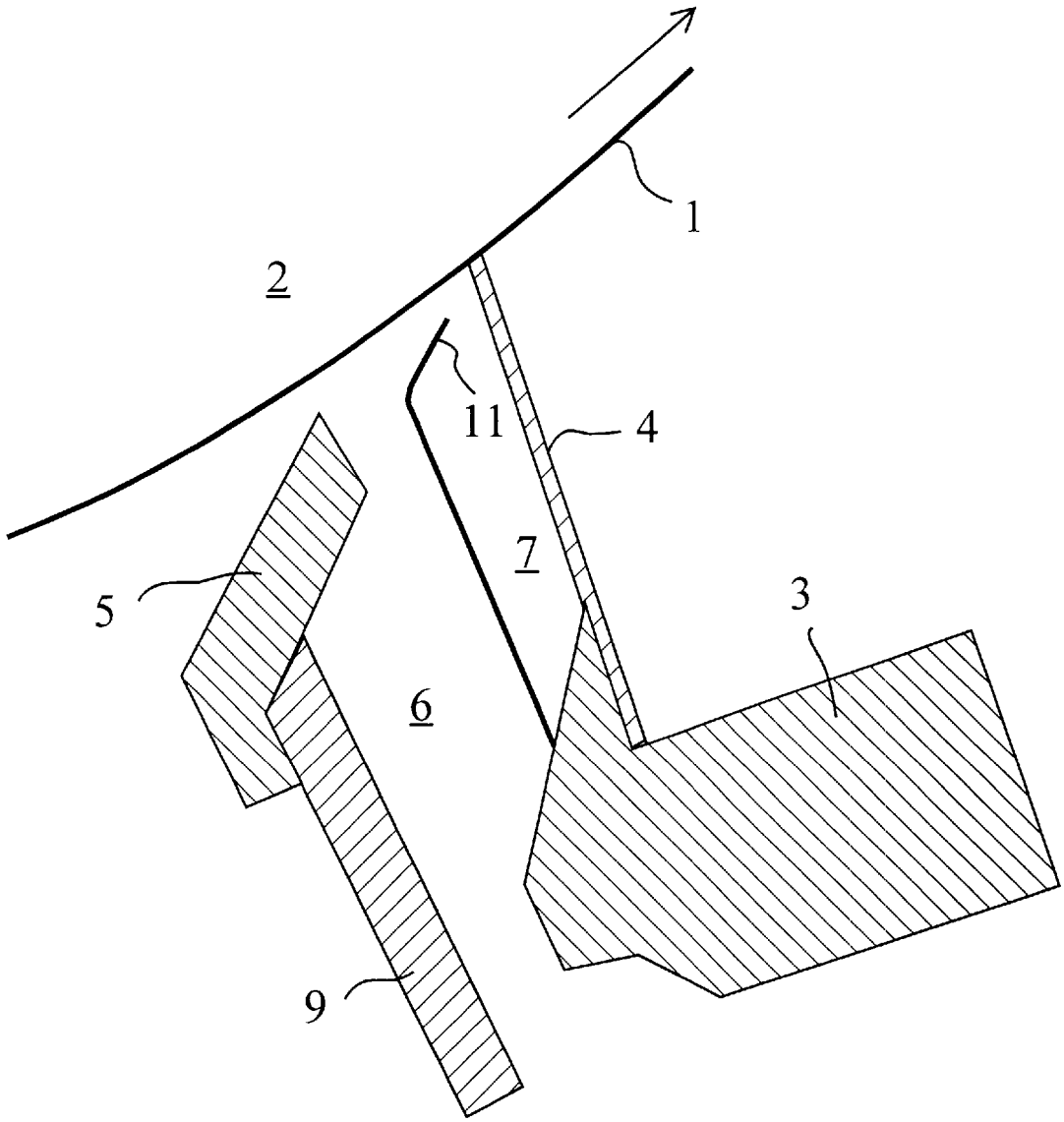
FIG. 3 is a schematic cross-section of a third short-dwell applicator according to the invention.
Figure 4:
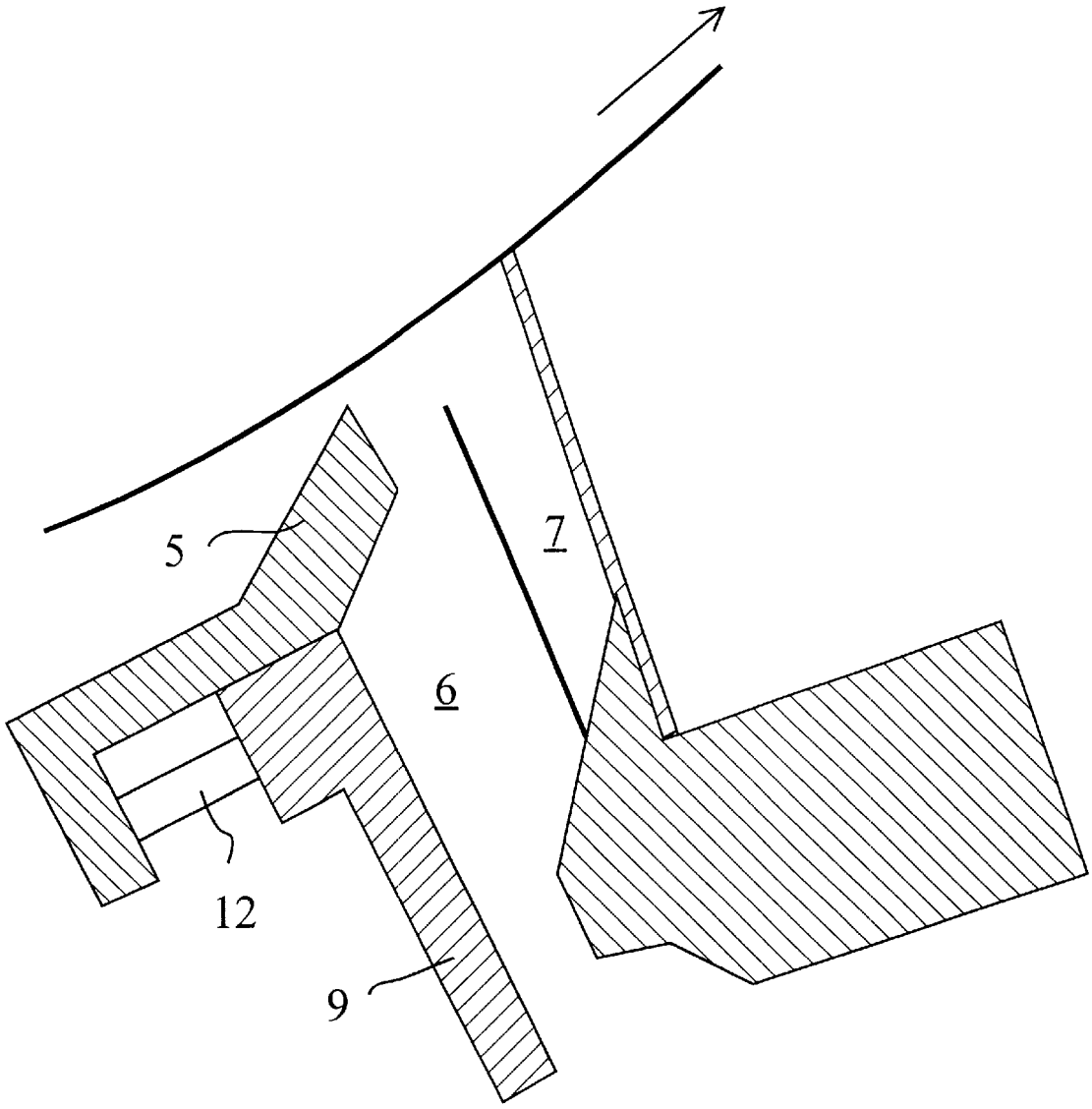
FIG. 4 is a schematic cross-section of a fourth short-dwell applicator according to the invention.

FIG. 2 illustrates another embodiment of the invention. In this solution the screen plate 10 is bent close to its tip 11 such that it is in contact with the spout 5 in the front wall 9 which it rests against, whereby both the flow from the supply orifices 8 and that returning from the blade 4 must travel through the screen plate 10, 11. The tip 11 of the screen plate protrudes towards the web from the point of, inflexion. In this embodiment, impurities entering the application chamber from the web 1 are at least partly prevented from accessing the supply orifices 8. In the solution of FIG. 3 the end 11 of the screen plate 10 is bent towards the doctor blade 4, whereby it presses the agent for treating the web towards the web 1 and in a clearer and more exact manner divides the flow into a flow towards the root of the blade 4 and a flow from the supply orifices towards the web. In this manner, when desired, it is possible to bring the end edge of the screen plate very close to the contact point between the web and the doctor blade, and thus, a very precise flow distribution is obtained. In FIG. 4 the solution of FIG. 1 has been modified further such that the spout 5 in the front wall of the application chamber 6, 7 is fixed to the front wall by means of an adjusting device 12. The adjusting device may comprise an array of screws set manually or by means of an actuator, or the like. Devices suited for this purpose are used e.g. to adjust doctor blades. The adjusting device can be used to move the spout with regard to the doctor blade 4, thus altering the length of the application area. The spout can be made flexible and the adjusting device can be divided into segments whereby the distance from the spout to the doctor blade may vary in the cross-machine direction. The spout can naturally also be divided into segments, but the risk of streak formation in the coat is hereby imminent. Normally it is also possible to adjust the distance from the front edge and the spout to the web 1 to adjust the overflow slit and the pressure in the application chamber. The adjustable front edge can be used in the embodiments described above on the condition that the screen plate is not attached to the spout or that the attachment is performed such that spout movement can be allowed. Within the scope of the present invention solutions differing from the embodiments described above are also conceivable. Instead of a doctor blade the arrangement may comprise a doctor rod which may be smooth or provided with grooves. The doctor means is usually selected in accordance with the product manufactured. The invention is also applicable in arrangements used to spread coating mix onto a film transfer roll or belt. The front wall may also comprise a flexible blade. The screen plate may be manufactured of many different materials, such as a corrosion-resistant metal or metal alloy, a plastic or composite material. Advantageously, the plate is easily detached to facilitate the cleansing of the application chamber.

Thus, while there have been shown and described and pointed out fundamental novel features of the present invention as applied to preferred embodiments thereof, it will be understood that various omissions and substitutions and changes in the form and details of the devices described and illustrated, and in their operation, and of the methods described may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. An apparatus for applying a treating agent onto a surface of a moving surface comprising:

a blade carrier;

a doctor means attached to the blade carrier;

a front wall positioned a distance from the doctor means, said front wall and said doctor means being positioned proximate to the moving surface so as to form an application chamber, substantially bounded by the moving surface, said front wall and said doctor means, the application chamber being provided with a means for feeding a treating agent into a portion of the application chamber substantially essentially opposite the moving surface, the application chamber being formed so that an excess of treating agent flows out of the application chamber only between the front wall and the moving surface and between the doctor means and the moving surface; and a screen plate positioned within the application chamber to at least partly divide the application chamber so that said doctor means is positioned on a side opposite to the means for feeding the treating agent into the application chamber.

2. The apparatus of claim 1, wherein said doctor means is a doctor blade and said screen plate is attached to said blade carrier and extends towards the moving surface.

3. The apparatus of claim 2, wherein said screen plate forms an angle of from 0° to 135° with a tangent to the moving surface.

4. The apparatus of claim 1, wherein said front wall comprises a spout which forms a slit with the moving surface, and wherein said screen plate contacts said spout.

5. The apparatus of claim 4, wherein the spout is fixed to said front wall by an adjusting device such that at least a distance from said spout to said doctor means is adjustable.

6. The apparatus of claim 5, wherein said spout is fixed to said front wall by an adjusting device such that a distance from said spout to said moving surface is adjustable.

7. The apparatus of claim 5, wherein said spout is fixed to said front wall by an adjusting device such that a position of said spout is adjustable across a width of the moving surface.

8. The apparatus of claim 5, further comprising a roll of a film transfer coater, and wherein the moving surface is a web supported by a roll of a film transfer coater.

9. The apparatus of claim 1, wherein a tip of said screen plate is bent toward a point of contact between the moving surface and said doctor means, and wherein the tip forms a canal with the moving surface tapering towards said doctor means.

10. The apparatus of claim 1, wherein the moving surface comprises a paper or board web.

11. The apparatus of claim 10, further comprising a roll of a film transfer coater, and wherein the moving surface is supported by a roll of a film transfer coater.

12. The apparatus of claim 1, wherein said doctor means comprises a doctor rod.

13. The apparatus of claim 1, further comprising a roll of a film transfer coater, and wherein the moving surface is a web supported by the roll of a film transfer coater.

14. The apparatus of claim 1, wherein the screen plate is positioned within the application chamber so as to permit flow of treating agent therethrough toward the front wall to reduce turbulence of the treating agent caused by return flow of the treating agent from the doctor means toward a lower portion of the application chamber.

15. An apparatus for applying a treating agent onto a surface of a moving surface comprising:

a blade carrier;

a doctor blade attached to the blade carrier;

a front wall positioned a distance from the doctor blade, said front wall and said doctor blade being positioned proximate to the moving surface so as to form an application chamber substantially bounded by the moving surface, said front wall and said doctor blade, the application chamber being provided with a means for feeding a treating agent into a portion of the application chamber substantially essentially opposite the moving surface; and a screen plate positioned within the application chamber to at least partly divide the application chamber so that said doctor blade is positioned on a side opposite to the means for feeding the treating agent into the application chamber, said screen plate being attached to said blade carrier and extending towards the moving surface.

16. The apparatus of claim 15, wherein said screen plate forms an angle of from 0° to 135° with a tangent to the moving surface.

17. The apparatus of claim 15, wherein a tip of said screen plate is bent toward a point of contact between the moving surface and said doctor blade, and wherein the tip forms a canal with the moving surface tapering towards said doctor blade.

18. An apparatus for applying a treating agent onto a surface of a moving surface comprising:

a blade carrier;

a doctor means attached to the blade carrier;

a front wall positioned a distance from the doctor means, said front wall and said doctor means being positioned proximate to the moving surface so as to form an application chamber substantially bounded by the moving surface, said front wall and said doctor means, the application chamber being provided with a means for feeding a treating agent into a portion of the application chamber substantially essentially opposite the moving surface, said front wall comprising a spout which forms a slit with the moving surface; and a screen plate positioned within the application chamber to at least partly divide the application chamber so that said doctor means is positioned on a side opposite to the means for feeding the treating agent into the application chamber, said screen plate contacting said spout.

19. The apparatus of claim 18, wherein the spout is fixed to said front wall by an adjusting device such that at least a distance from said spout to said doctor means is adjustable.

20. The apparatus of claim 19, wherein said spout is fixed to said front wall by an adjusting device such that a distance from said spout to said moving surface is adjustable.

21. The apparatus of claim 19, wherein said spout is fixed to said front wall by an adjusting device such that a position of said spout is adjustable across a width of the moving surface.

22. The apparatus of clam 19, further comprising a roll of a film transfer coater, and wherein the moving surface is a web supported by a roll of a film transfer coater.

23. The apparatus of claim 18, wherein a tip of said screen plate is bent toward a point of contact between the moving surface and said doctor means, and wherein the tip forms a canal with the moving surface tapering towards said doctor means.

* * * * *